United States Patent [19]

Person

[11] 4,157,543

[45] Jun. 5, 1979

[54] INDICIA DISPLAY DEVICE

[75] Inventor: Herman R. Person, Columbus, Nebr.

[73] Assignee: Dale Electronics, Inc., Columbus, Nebr.

[21] Appl. No.: 832,398

[22] Filed: Sep. 12, 1977

[51] Int. Cl.[2] ..... H01J 17/48

[52] U.S. Cl. ..... 340/758; 313/518; 313/519; 340/779

[58] Field of Search ..... 340/336, 343, 344, 378 R; 313/517, 518, 519

[56] References Cited

U.S. PATENT DOCUMENTS

| | | | |
|---|---|---|---|
| 3,728,571 | 4/1973 | Uemura et al. | 313/518 |
| 3,786,487 | 1/1974 | Yanagisawa | 340/343 X |
| 3,824,582 | 7/1974 | Glaser et al. | 340/343 X |
| 3,912,964 | 10/1975 | Kouyama et al. | 313/517 X |

*Primary Examiner*—David L. Trafton
*Attorney, Agent, or Firm*—Zarley, McKee, Thomte, Voorhees & Sease

[57] ABSTRACT

The indicia display device of the present invention comprises a sealed compartment having a dielectric substrate therein. A plurality of first conductor runs are imposed on the substrate which is subsequently coated with a first layer of dielectric material having a plurality of apertures therethrough. The apertures provide vias for a plurality of second conductors to electrically connect the first conductors to a pre-determined pattern of indicia cathode segments superimposed on the first layer of dielectric material. The apertures are remotely positioned from the cathode segments and may be located either within or without the pattern of cathode segments. A second layer of delectric material is imposed on the first layer covering the apertures and second conductors with the edges of this layer abutting the edges of the cathode segments. A thin transparent anode is located on the inner surface of the window of the sealed compartment. An ionizable gas is within the compartment and produces a cathode glow adjacent cathode segments whenever an electrical potential of predetermined magnitude is imposed between the cathodes and anodes.

9 Claims, 8 Drawing Figures

INDICIA DISPLAY DEVICE

BACKGROUND OF THE INVENTION

The present invention relates to an electrical indicia display device, and more particularly to an electrical indicia display device having a layer of dielectric material interposed between the cathode segments and the conductor runs of the dielectric substrate base. Previous display devices utilize apertures in the dielectric layer directly below the superimposed cathode segments to provide electrical contact between the cathode segments and the conductor runs on the substrate. Various size apertures relative to the superimposed cathode segments have been utilized. Location of the apertures directly beneath the cathode segments to connect the cathode segments to the conductor runs creates a slight indentation in the cathode segment above the aperture and produces a non-uniform glow when a predetermined voltage is applied across the anode and cathode.

SUMMARY OF THE INVENTION

An indicia display device is disclosed wherein a first layer of dielectric material having a plurality of conductor apertures therethrough is imposed upon the upper surface of a dielectric substrate having a plurality of conductor runs imposed thereon. The conductor runs are electrically connected to cathode segments superimposed on the layer of dielectric material by conductor passing through the apertures. The apertures are remotely positioned from the cathode segments and may be located either within the pattern of cathode segments or without the pattern of cathode segments. A second layer of dielectric material is imposed on the first layer covering the conductors and apertures with the edges of the second layer abutting the edges of the cathode segments. The dielectric substrate is located within a sealed compartment containing an ionizable gas with a window for viewing into the compartment. The anode is located on the inside surface of the window. A potential difference of predetermined magnitude applied across electrical leads connected to the anode and electrical leads connected to the conductor runs results in a cathode glow in the ionizable gas adjacent the cathode segments.

It is a principal object of the invention to provide an indicia display device that produces a uniform glow adjacent the cathode segments.

A further object of the invention is to provide an indicia display device having a layer of dielectric material interposed between the conductor runs of the substrate and the cathode segments with electrical connections between cathode segments and the conductor runs being made through apertures in the dielectric layer located remotely from the cathode segments.

A still further object of the invention is to provide an indicia display device in which the surface of the cathode segment is uniform and displays no indentations.

A still further object of the invention is to provide an improved electrical indicia display device.

A still further object of the invention is to provide an electrical indicia display device that is economical to manufacture refined in appearance and durable in use.

BRIEF DESCRIPTION OF THE DRAWINGS

This invention consists in the construction, arrangements, and combination of the various parts of the device, whereby the objects contemplated are attained as hereinafter more fully set forth, specifically pointed out in the claims, and illustrated in the accompanying drawings in which:

DESCRIPTION OF THE PREFERRED EMBODIMENT

Figure 1:
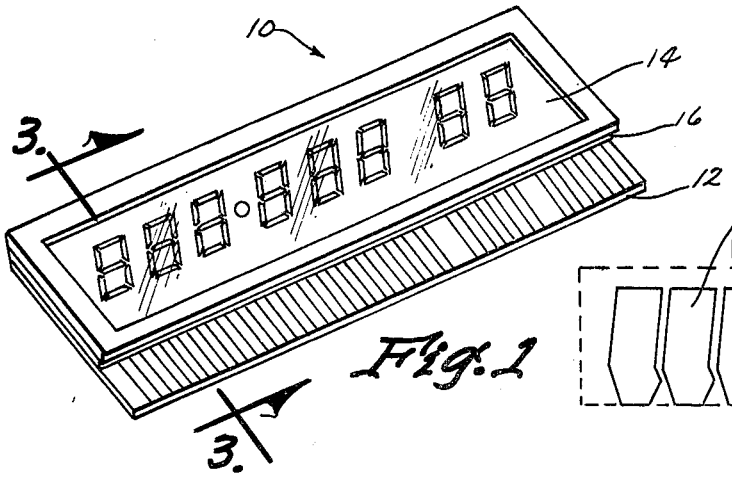
FIG. 1 is a perspective view of the present invention.

Referring to the drawings, the numeral 10 refers to the indicia display device of the present invention. Device 10 comprises a housing formed by dielectric substrate 12 and a glass window 14 which are joined in spaced parallel relationship by a glass solder material 16 so as to form a sealed compartment 18 therebetween. Substrate 12 includes an aperture 20 therein which provides a communication into the interior of compartment 18. A glass tube 22 is secured over aperture 20 by means of glass solder 23. Glass tube 22 has been melted to close off its end 24 and thereby hermetically seal compartment 18 from the atmosphere.

Figure 2:
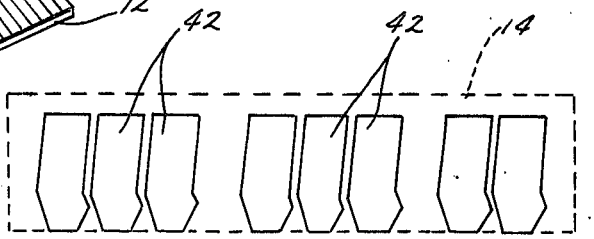
FIG. 2 is a plan view showing the anodes imprinted on the window of the device.
Figure 2A:
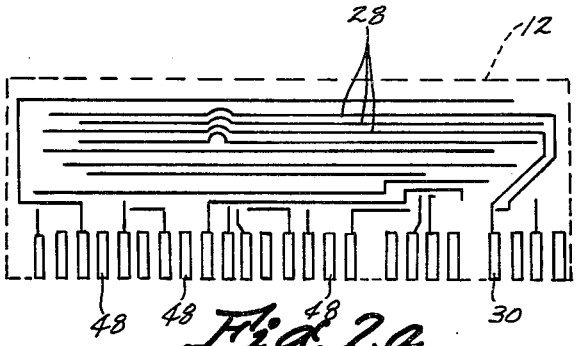
FIGS. 2*a*, 2*b*, 2*c* and 2*d* are plan views showing the substrate having the first, second, third and fourth printing thereon, respectively.

Superimposed on the inward surface of substrate 12 is a pattern comprised of a plurality of elongated conductors 28 in electrical connection with a plurality of leads 30 positioned adjacent the edge of substrate 12 as shown in FIG. 2*a*. Conductor 28 are preferably composed of a mixture of glass powder and silver.

Figure 2B:
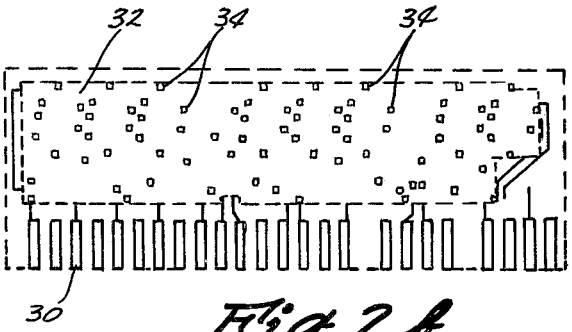

A coating of dielectric material, layer 32, containing apertures or holes 34 therethrough, covers substrate 12 and conductors 28 as shown in FIG. 2*b*. The location of the apertures 34 is arranged so as to be in registered alignment with various conductors 28 shown in FIG. 2*a*. Dielectric layer 32 is preferably of a vitrous enamel material to provide good insulation characteristics.

Figure 2C:
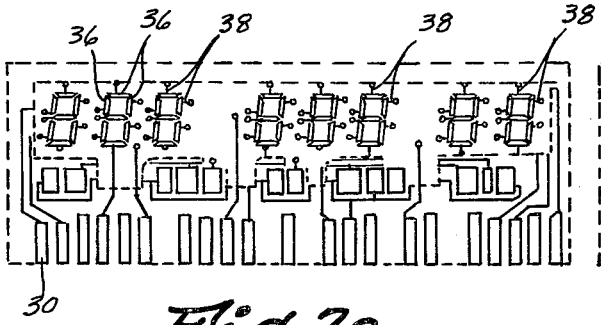

A plurality of cathode segments 36 are imposed on dielectric layer 32 in a number of figure eight patterns as shown in FIG. 2*c*. The figure eight patterns of the cathode segments 36 are positioned in relation to apertures 34 such that the cathode segments 36 do not coincide or overlie apertures 34. The electrode material of cathode segments 36 is preferably of a nickel or silver composition.

Conductors 38 electrically connect each individual cathode segment 36 to a particular conductor 28 located on substrate 12. Conductors 38 extend from cathode segments 36 through apertures 34 of dielectric layer 32 to conductors 28, which are in turn electrically connected to leads 30. Conductors 38 are preferably of the same composition as cathode segments 36.

Figure 2D:
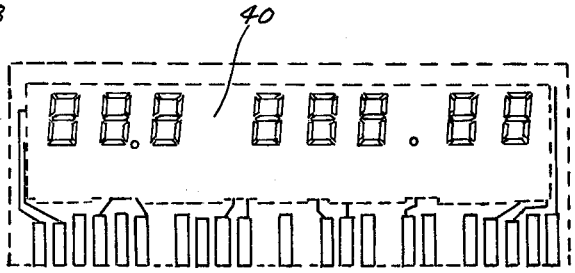

A second dielectric layer 40 is imposed over conductors 38 and apertures 34 so as to abut the edges of cathode segments 36 as shown in FIG. 2*d*. Dielectric layer 40 is preferably of a glass powder composition (vitrous enamel material) similar to that of dielectric layer 32. Dielectric layer 40 is also of a dull, non-reflective dark nature to facilitate illumination of the characters.

Figure 3:
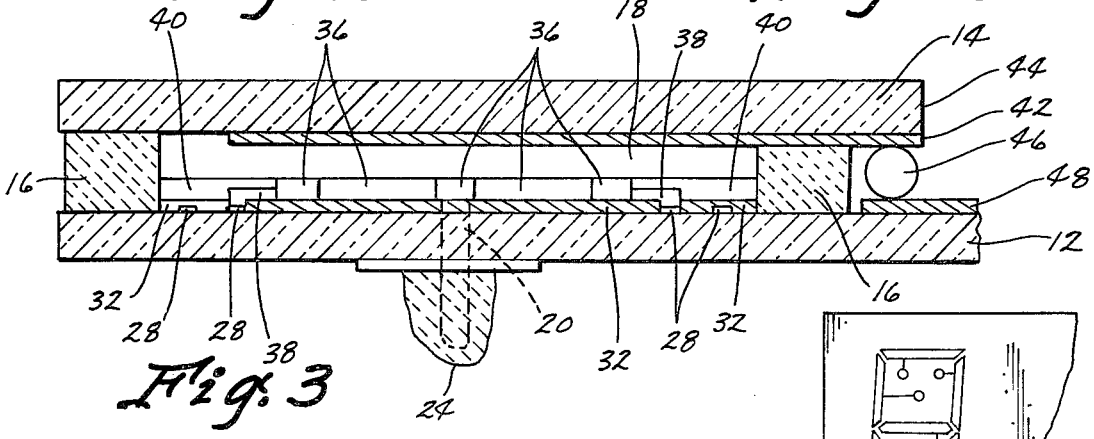
FIG. 3 is an enlarged sectional view seen on line 3—3 of FIG. 1.

Anodes 42 are located on the inner surface of window 14 (FIG. 2). Each anode 42 is comprised of a thin transparent film so as to be substantially coplanar with the inner surface of window 14. Each anode 42 is in vertical alignment with a respective figure eight pattern of cathode segments 36. Anodes 42 extend to the outer edge 44 of window 14 so as to be electrically connected by conductor 46 to anode leads 48 (FIG. 3) which are located adjacent cathode leads 30 on substrate 12 as shown in FIG. 2*a*. Anode conductors 46 are preferably of a silver epoxy resin composition.

Imposing a potential difference of predetermined magnitude between selected leads 30 and 48 produces a uniform glow in the ionizable gas within space 18 adjacent the cathode segments 36 corresponding to the particular leads 30. Various patterns of cathode segments 36 can be illuminated in a conventional manner by selection of the various combinations of leads 30 and 48 across which the voltage is applied. The dull, non-reflective dark characteristic of dielectric layer 40 contributes to the distinction of the glow adjacent cathode segments 36.

Figure 4:
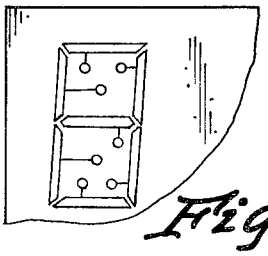
FIG. 4 is a view similar to FIG. 2*c* but showing an alternate form of the invention.

By locating apertures 34 remote from cathode segments 36, no indentation of the surface of cathode segments 36 is encountered and a uniform glow is therefore produced. Apertures 34 may be located either within the figure eight pattern of cathode segments 36 (FIG. 4) or without the patern (FIG. 2*c*).

Thus, it can be seen that the device accomplishes at least all of its stated objectives.

What is claimed is:

1. A dielectric substrate for an indicia display device, having an upper surface, comprising, a plurality of first conductors imposed on said substrate, a first layer of dielectric material imposed on said conductors, said first layer having a plurality of apertures therethrough, a plurality of indicia cathode segments superimposed on said first layer in a predetermined pattern, said cathode segments remotely positioned from said apertures, a plurality of second conductors on said first layer electrically connecting said cathode segments to said first conductors, said second conductors passing through said apertures of said first layer of dielectric material and a second layer of dielectric material imposed on said first layer and said second conductors, the edges of said second layer abutting the edges of said cathode segments.

2. The device of claim 1 wherein said second layer is a dullnon-reflective material.

3. The device of claim 1 wherein said apertures are located within said predetermined pattern of said cathode segments.

4. The device of claim 1 wherein said apertures are located without said predetermined pattern of said cathode segments.

5. An indicia display device comprising, a housing having a sealed compartment formed therein and a window for viewing into said compartment, a dielectric substrate having an upper surface presented inwardly towards said compartment a plurality of first conductors imposed on said substrate, a first layer of dielectric material imposed on said conductors, said first layer having a plurality of apertures therethrough, a plurality of indicia cathode segments superimposed on said first layer in a predetermined pattern, said cathode segments positioned remotely from said apertures, a plurality of second conductors on said first layer electrically connecting said cathode segments to said first conductors, said second conductors passing through said apertures of said first layer of dielectric material, a second layer of dielectric material imposed on said first layer and said second conductor, the edges of said second layer abutting the edges of said cathode segments, an ionizable gas within said compartment and in communication with said cathode segments, at least one anode associated with said predetermined pattern of said cathode segments, said anode being spaced from and positioned generally parallel to said pattern, and conductor means electrically connected to said anode and said first conductors for connection to a voltage source to impose a potential difference of predetermined magnitude between said anode and selected ones of said cathode segments such that said gas will become ionized adjacent said selected cathode segments.

6. The device of claim 5 wherein said apertures are located within said predetermined pattern of said cathode segments.

7. The device of claim 5 wherein said apertures are located without said predetermined pattern of said cathode segments.

8. The device of claim 5 wherein said second layer is a dull, non-reflective material.

9. The device of claim 5 wherein said anode comprises a thin, transparent film on the lower surface of said window.

* * * * *